US006281791B1

(12) United States Patent
Murao

(10) Patent No.: US 6,281,791 B1
(45) Date of Patent: Aug. 28, 2001

(54) FIRE ALARM SYSTEM

(75) Inventor: Shuichi Murao, Tokyo (JP)

(73) Assignee: Nohmi Bosai, Ltd., Tokyo (JP)

( * ) Notice: Subject to any disclaimer, the term of this patent is extended or adjusted under 35 U.S.C. 154(b) by 0 days.

(21) Appl. No.: 09/329,326

(22) Filed: Jun. 10, 1999

(30) Foreign Application Priority Data

Jun. 15, 1998 (JP) ..... 10-167125

(51) Int. Cl.[7] ..... G08B 25/00

(52) U.S. Cl. ..... 340/524; 340/506; 340/507; 340/524; 340/525; 340/531; 340/533

(58) Field of Search ..... 340/506, 507, 340/508, 514, 524, 525, 531, 533, 538

(56) References Cited

U.S. PATENT DOCUMENTS

| | | | |
|---|---|---|---|
| 4,067,008 | 1/1978 | Sprowls, III | 340/505 |
| 4,342,985 | 8/1982 | Desjardins | 340/525 |
| 4,543,565 | 9/1985 | Oberstein et al. . | |
| 4,658,243 | 4/1987 | Kimura et al. | 340/505 |
| 4,665,390 | 5/1987 | Kern et al. . | |
| 4,988,988 | 1/1991 | Kimura . | |
| 5,485,142 | 1/1996 | Stute et al. . | |
| 5,705,979 * | 1/1998 | Fierro et al. | 340/517 |
| 5,734,321 | 3/1998 | Takahashi | 340/505 |

FOREIGN PATENT DOCUMENTS

| | | |
|---|---|---|
| 2013610 | 1/1994 | (CA) . |
| 0 319 266 | 11/1988 | (EP) . |
| 07200957 | 8/1995 | (JP) . |
| 09102089 | 4/1997 | (JP) . |

* cited by examiner

*Primary Examiner*—Daryl Pope
(74) *Attorney, Agent, or Firm*—Wenderoth, Lind & Ponack, L.L.P.

(57) ABSTRACT

A fire alarm system is obtained which can simplify the structure and reduce the costs by specifying the number of terminal devices in a supervision region and setting a plurality of fire zone indications in correspondence with the terminal devices of the specified number by one to one, and which can finely supervise the contents of a standby power supply and improve the reliability of the equipment. In a fire alarm system in which such as a plurality of terminal devices 251 for fire supervision to which different addresses are allocated, respectively, are connected to a fire control and indicating equipment 101, and the fire control and indicating equipment calls the terminal device by its address to collect fire information from the called terminal device, the fire control and indicating equipment includes a plurality of fire zone indicator lamp 112 corresponding to the plurality of terminal devices by one to one.

18 Claims, 8 Drawing Sheets

FIRE ALARM SYSTEM

BACKGROUND OF THE INVENTION

1. Field of the Invention

The present invention relates to a fire alarm system, and more particularly to a fire alarm system in which a plurality of terminal devices for fire supervision such as fire detectors or transmitters to which different addresses are given, respectively, are connected to a fire control and indicating equipment (or a fire alarm panel).

2. Description of the Related Art

In general, in a fire alarm system, a plurality of terminal devices for fire supervision such as fire detectors or transmitters to which different addresses are given, respectively, are connected to a fire control and indicating equipment, and the fire control and indicating equipment calls the terminal device by its address so as to collect fire information from the called terminal device or to send an instruction to the called terminal device if necessary.

Also, there is, for example, a fire alarm system having accumulating means which judges that there is a fire when the fire control and indicating equipment collects the fire information from a plurality of terminal devices for fire supervision such as a fire detector or a transmitter in succession, and collects, when the collected fire information is information from which it is judged that a fire occurs, the fire information from which it is judged that a fire occurs from the terminal device over a given period of time. The fire alarm system of this type is generally furnished with a standby power supply ready for emergency such as service interruption.

Incidentally, in the case of the conventional fire alarm system of this type, addresses are allocated to all of plural terminal devices for fire supervision which exist in the supervision area of the fire alarm system, and the fire alarm panel calls all of those addresses to collect fire information. Therefore, the collected information increases as much as the number of supervised terminal devices, as a result of which there arises such a problem that an MPU that processes the information, indicator means and so on are large-scaled, the structure becomes complicated and the costs are increased. Also, there arises such a problem that it is difficult to conduct a judgement on a fire and an alarm processing on the basis of only the collected information in processing the fire information relating to the-supervision area.

Also, the furnished standby power supply is connected to the fire control and indicating equipment so that the operation of the former is supervised by the latter. However, the supervising contents are to merely check whether the standby power supply is operative, or not, resulting in such a problem that the contents of the standby power supply cannot be finely supervised.

SUMMARY OF THE INVENTION

The present invention has been made to solve the above problems with the conventional system, and therefore an object of the present invention is to provide a fire alarm system which specifies the number of terminal devices in a supervision area and sets a plurality of fire zone indications corresponding to the specified number of terminal devices by one to one, thereby making it possible to simplify the structure and reduce the costs.

Another object of the present invention is to provide a fire alarm system high in reliability which is capable of finely supervising the contents of a standby power supply connected to a fire control and indicating equipment.

In order to achieve the above objects, according to a first aspect of the present invention, there is provided a fire alarm system in which a plurality of terminal devices for fire supervision to which different addresses are allocated, respectively, are connected to a fire control and indicating equipment, and the fire control and indicating equipment calls the terminal device by its address to collect fire information from the called terminal device, wherein the fire control and indicating equipment includes a plurality of fire zone indicating means corresponding to the plurality of terminal devices by one to one.

A second aspect of the present invention is achieved by the provision of a fire alarm system according to the first aspect of the present invention, wherein the addresses are allocated in serial numbers to the plurality of terminal devices, respectively, and the same zone numbers as the addresses are allocated to the plurality of fire zone indicating means in succession.

A third aspect of the present invention is achieved by the provision of a fire alarm system according to the first or second aspect of the present invention, wherein the fire zone indicating means comprises a fire zone lamp, an abnormal zone lamp and a zone indication board.

A fourth aspect of the present invention is achieved by the provision of a fire alarm system according to the third aspect of the present invention, wherein there is provided discriminating means for discriminating the fire information collected from the terminal devices, and when the discrimination result of the discriminating means is indicative of abnormality except fire, the abnormality contents are indicated by the abnormality zone lamp.

According to a fifth aspect of the present invention, there is provided a fire alarm system in which a plurality of terminal devices for fire supervision to which different addresses are allocated, respectively, are connected to a fire control and indicating equipment, and the fire control and indicating equipment calls the terminal device by its address to conduct at least one of the collection of fire information from the called terminal device and/or the sending of an instruction to the called terminal device, wherein address setting means is provided in each of the plurality of terminal devices, and the fire control and indicating equipment comprises storing means for storing the addresses to be set on the plurality of terminal devices, address collecting means for paging the plurality of terminal devices in succession to collect the addresses set by the address setting means from the called terminal device, address discriminating means for discriminating whether the addresses collected by the address collecting means are addresses stored in the storing means, or not, and indicating means for indicating a discrimination result when the address discriminating means discriminates that the collected addresses are addresses different from the addresses stored in the storing means.

A sixth aspect of the present invention is achieved by the provision of a fire alarm system according to the fifth aspect of the present invention, wherein the fire control and indicating equipment is provided as the indicating means with a plurality of indicator lamps corresponding to the plurality of terminal devices by one to one, the storing means stores the addresses of the terminal devices connected to the fire control and indicating equipment in correspondence with the plurality of indicator lamps therein, and the indicating means controls the lighting of the indicator lamps corresponding to the addresses stored in the storing means when the discriminating means discriminates that the collected addresses are addresses different from the addresses stored in the storing means.

According to a seventh aspect of the present invention, there is provided a fire alarm system in which a fire control and indicating equipment has storing means for collecting fire information from a plurality of terminal devices for fire supervision in succession, and judging that there is a fire when collecting fire information from which it is judged that a fire occurs from the terminal device over a predetermined period of time, in the case where the collected fire information is information from which it is judged that a fire occurs, wherein different classification information depending on the classifications of the terminal devices is allocated to the plurality of terminal devices, and the fire control and indicating equipment includes fire state judging means for judging that there is a fire immediately when collecting the fire information collected from the terminal device of a specific classification which is the fire information from which it is judged that a fire occurs.

An eighth aspect of the present invention is achieved by the provision of a fire alarm system according to the seventh aspect of the present invention, wherein there is provided classification storing means for storing the classification information of the plurality of terminal devices which are connected to the fire control and indicating equipment therein, and the fire state judging means judges whether the terminal device from which the fire information is collected is of the specific classification, or not, according to the classification information stored in the classification storing means.

According to a ninth aspect of the present invention, there is provided a fire alarm system in which a plurality of terminal devices for fire supervision to which different addresses are allocated, respectively, are connected to a fire control and indicating equipment, and the fire control and indicating equipment calls the terminal device by its address to collect fire information from the called terminal device, wherein classification information is allocated to the plurality of terminal devices according to the classification of the terminal devices, and the fire control and indicating equipment comprises an indicator for indicating at least the classification of the plurality of terminal devices, an indicator lamp for indicating the state of the terminal devices corresponding to the plurality of terminal devices by one to one and a classification indication switch for selecting a terminal device from the plurality of terminal devices, so as to indicate the classification of the designated terminal device in the indicator and control the lighting of the indicator lamp corresponding to the designated terminal device when the classification indication switch is manipulated.

According to a tenth aspect of the present invention, there is provided a fire alarm system in which a plurality of terminal devices for fire supervision are connected to a fire control and indicating equipment, and the fire control and indicating equipment collects fire information from the plurality of terminal devices and judges whether a fire occurs or not from the collected fire information, wherein the fire control and indicating equipment comprises timer means having a timer section and an indicator which indicates a time output of the timer section, and time mode switching means for switching, in indicating a time output of the timer section on the indicator, between a normally indicating mode in which the time output is always indicated on the indicator, and a fire-time indicating mode in which the time output is not normally indicated on the indicator but the time output is indicated on the indicator when it is judged that there is a fire from the fire information.

An eleventh aspect of the present invention is achieved by the provision of a fire alarm system according to the tenth aspect of the present invention, wherein the timer means fixedly indicates the timer indication on the indicator at a point of time of judgement when it is judged that a fire occurs from the collected fire information.

According to a twelfth aspect of the present invention, there is provided a fire alarm system in which a plurality of terminal devices for fire supervision are connected to a fire control and indicating equipment, and the fire control and indicating equipment receives fire information from the terminal devices, wherein the fire control and indicating equipment is provided with supervising means for supervising the abnormality of the interior of a standby power supply installed in or connected to the fire control and indicating equipment on the basis of detection information from the standby power supply.

A thirteenth aspect of the present invention is achieved by the provision of a fire alarm system according to the twelfth aspect of the present invention wherein the supervising means comprises first discriminating means for discriminating the disconnection of the standby power supply, second discriminating means for discriminating the short-circuiting of the standby power supply, and third discriminating means for discriminating the failure of a charging circuit in the standby power supply.

A fourteenth aspect of the present invention is achieved by the provision of a fire alarm system according to the twelfth or thirteenth aspect of the present invention wherein the standby power supply includes detecting means for detecting a battery voltage and a reference voltage.

A fifteenth aspect of the present invention is achieved by the provision of a fire alarm system according to the fourteenth aspect of the present invention wherein the detecting means comprises first and second comparison circuits for detecting the failure of the charging circuit, a third comparison circuit for detecting the short-circuiting of the battery and a fourth comparison circuit for detecting the disconnection of the battery.

A sixteenth aspect of the present invention is achieved by the provision of a fire alarm system according to any one of the twelfth to fifteenth aspects of the present invention wherein the fire control and indicating equipment includes indicating means for indicating the abnormality of the interior of the standby power supply.

According to a seventeenth aspect of the present invention, there is provided a fire alarm system in which a plurality of terminal devices for fire supervision are connected to a fire control and indicating equipment, and there are provided a plurality of fire zone lamps which light in correspondence with the terminal devices that send the fire information from which it is judged that a fire exists when the fire control and indicating equipment receives fire information from the terminal devices and it is judged that the fire exists from the fire information received from any one of the terminal devices, wherein the fire control and indicating equipment includes an indicator and a plurality of abnormal-zone lamps corresponding to the plurality of fire zone lamps, the abnormal-zone lamps are lighted under control when abnormality occurs in the terminal device in charge of the corresponding fire zone lamp, and the abnormality contents are indicated on the indicator.

An eighteenth aspect of the present invention is achieved by the provision of a fire alarm system according to the seventeenth aspect of the present invention, wherein the plurality of fire zone lamps and the plurality of abnormal-zone lamps disposed in correspondence with the fire zone lamps are disposed in correspondence with the plurality of terminal devices by one to one.

A nineteenth aspect of the present invention is achieved by the provision of a fire alarm system according to the seventeenth or eighteenth aspect of the present invention, wherein the indicator is made up of 1 to 7 segment indicator elements, and the abnormality contents are indicated in codes.

BRIEF DESCRIPTION OF THE DRAWINGS

The novel features of the present invention, as well as other features and advantages thereof, will be best understood by reference to the detailed description which follows, read in conjunction with the accompanying drawings, wherein.

DETAILED DESCRIPTION OF THE PREFERRED EMBODIMENTS

Now, a description will be given in more detail of a preferred embodiment of the present invention with reference to the accompanying drawings.

FIRST EMBODIMENT

Figure 1:
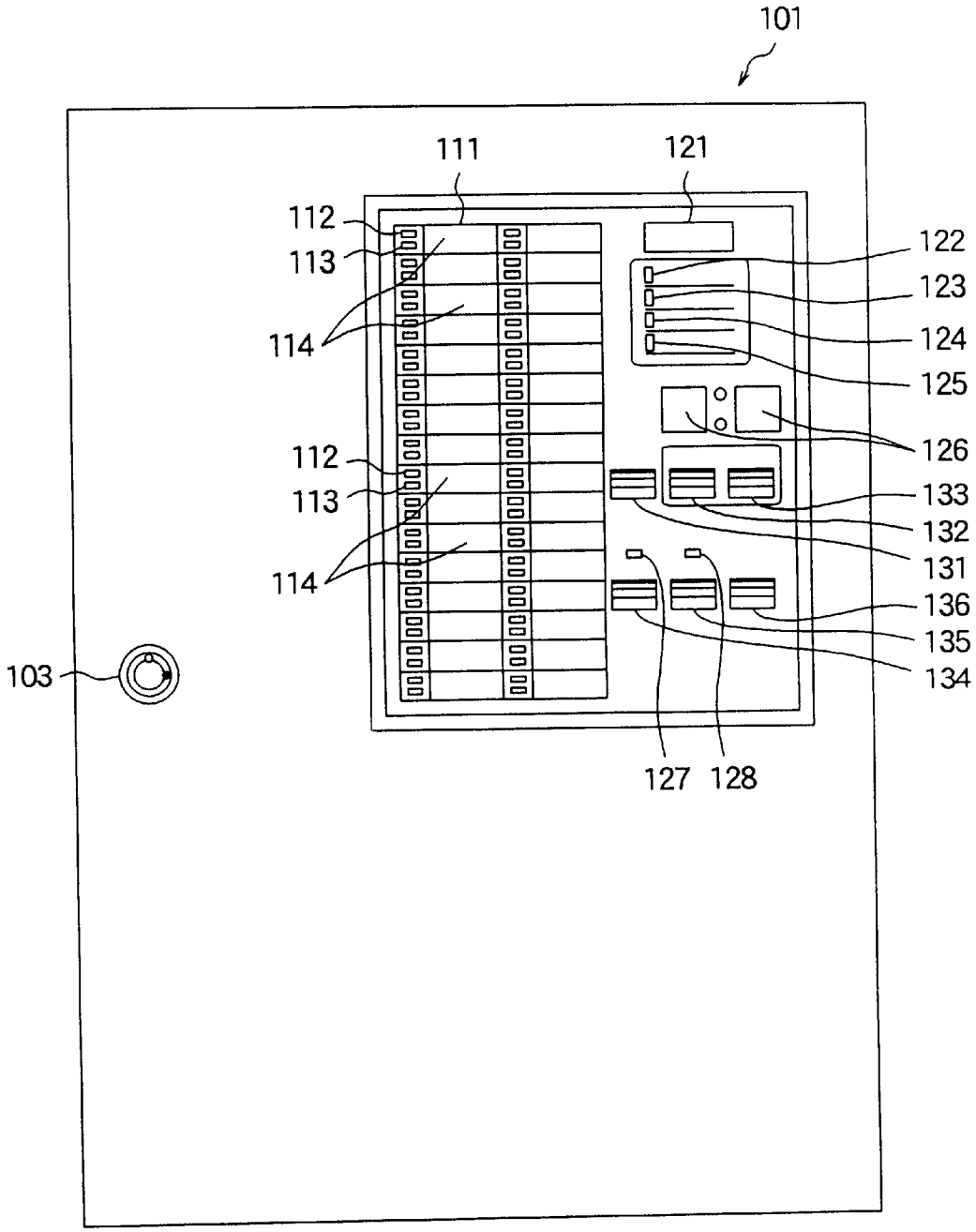
FIG. 1 is a front view schematically showing the structure of a fire control and indicating equipment (or a fire alarm panel) in accordance with an embodiment of the present invention.

FIG. 1 is a front view schematically showing the overall structure of a fire control and indicating equipment in accordance with an embodiment of the present invention.

In the figure, reference numeral 101 denotes a fire control and indicating equipment; 102, a front door; 103, a lock; 111, a fire zone window; 112, fire zone lamps (e.g., LEDs); 113, abnormal-zone lamps (e.g., LEDs); 114, zone indicating boards on which fire zone numbers or fire zone place names are described; and 121, a fire lamp (e.g., LED) which lights when receiving fire information from which it is judged that a fire occurs from any zone. Also, reference numeral 122 denotes an a.c. power source lamp (e.g., LED); 123, a standby power supply lamp (e.g., LED); 124, a failure representation lamp (e.g., LED); 125, an accumulating lamp (e.g., LED); 126, an indicator which also functions as timer means and is made up of a plurality of seven-segment displays (four in this example); 127, a main alarm sounding stop lamp which lights during the alarm sounding stop of a main alarm sounding device; and 128, a local alarm sounding stop lamp which lights during the alarm sounding stop of a local alarm sounding device. Further, reference numeral 131 denotes a test switch; 132, a setting switch which is also used as, for example, a classification indicator switch; 133, a time setting switch; 134, a main alarm sounding stop switch which stops the alarm sounding of the main alarm sounding device (for example, a piezoelectric buzzer, an electric bell, etc.) disposed in the control and indicating equipment; 135, a local alarm sounding stop switch which stops the alarm sounding of the local alarm sounding device (for example, a piezoelectric buzzer, an electric bell, a speaker, etc.) disposed in the fire surveillance zone; and 136, a fire alarm resetting switch. The structural elements 111 to 114 constitute fire zone indicating means.

Figure 2:
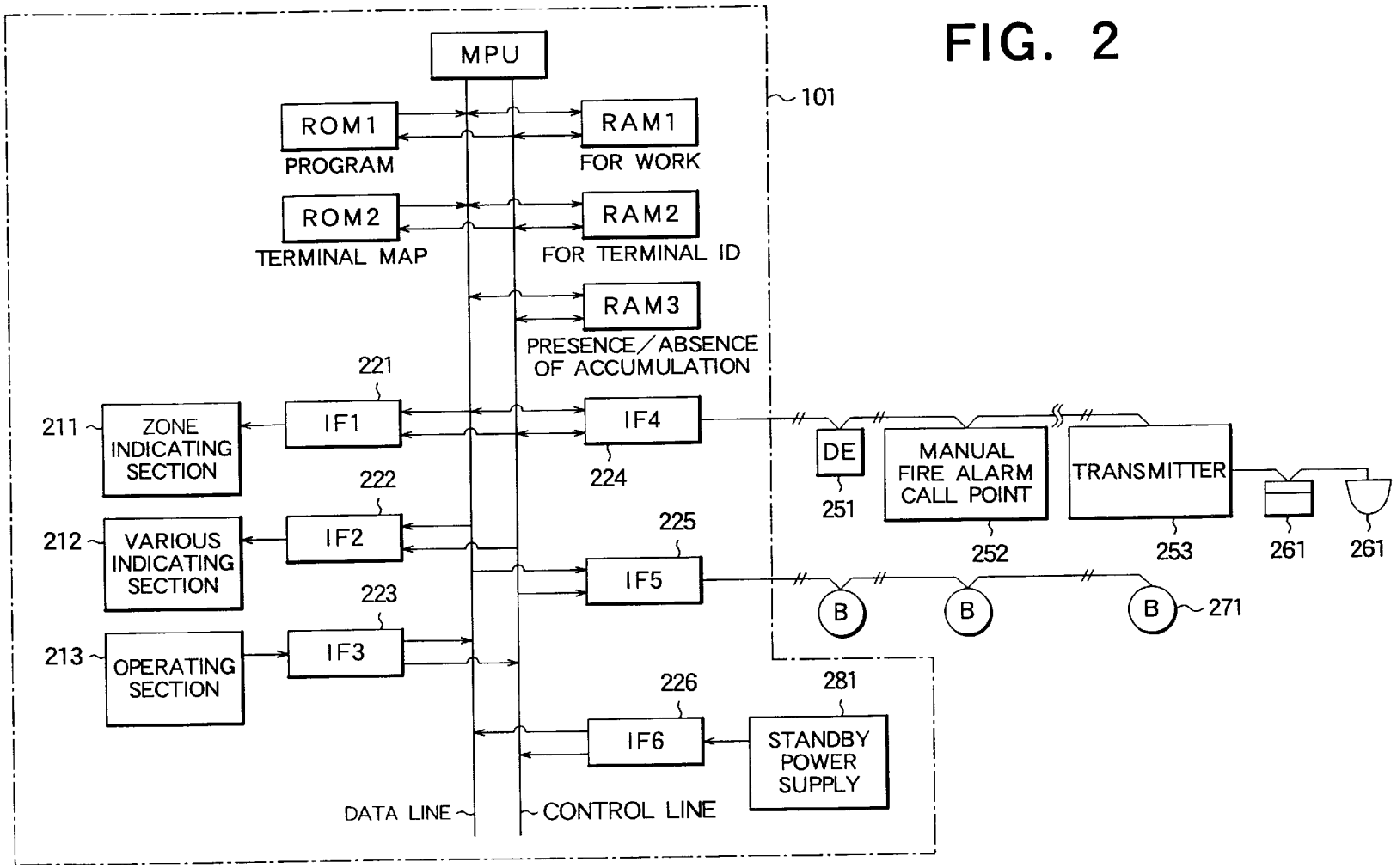
FIG. 2 is a circuit structural diagram showing the embodiment of the present invention.

FIG. 2 is a system chart showing the first embodiment of the present invention.

An MPU indicates a microcomputer; a ROM 1 is a ROM such as an EPROM in which program is stored; a ROM 2 is a ROM such as an EEPROM in which the addresses and the classifications of the terminal devices are stored in an electrically rewriteable manner; a RAM 1 is a RAM for operation; a RAM 2 is a RAM by which the contents of the ROM 2 is read and stored at the time of running; and a RAM 3 is a RAM which is used as a timer for accumulation. Those ROMs 1, 2 and RAMs 1 to 3 are connected to the MPU through a data line and a control line, respectively.

Reference numeral 211 denotes a zone indicating section disposed in the fire zone window 111; 212, various indicating sections in which various indicating lamps such as the fire lamps 121 to the local alarm sounding stop lamp 128 are disposed; 213, an operating section in which various devices such as the test switch 131 to the fire alarm resetting switch 136 are disposed; and 221 to 226, interfaces (IF1 to IF6) connected to the data line and the control line from the MPU, respectively. The zone indicating section 211 is connected to the interface 221, the various indicating section 212 is connected to the interface 222, and the operating section 213 is connected to the interface 223.

Reference numeral 251 denotes a fire detector of the analog smoke sensitive or heat sensitive type which is connected to the interface 224; 252 and 253, a manual fire alarm call point and a transmitter which are similarly connected to the interface 224, respectively; 261, a fire detector of the general type (on/off type) which is connected to the transmitter 253 and outputs a fire signal when detecting a fire phenomenon (smoke, heat, flame, gas or the like) from which it is judged that there is a fire; 271, a local alarm sounding device connected to the interface 225; and 281, a standby power supply connected to the interface 226.

Incidentally, for example, addresses of #1 to #32 are allocated to the fire detector 251 to the transmitter 253 in the order from the fire control and indicating equipment 101 side in this embodiment. Also, the fire detector 251 to the transmitter 253 which are terminal devices each having an address are equipped with address setting means (for example, a dip switch, a rotary dip switch, EEPROM, etc.) for setting a self address and a group address to which the self address belongs. Also, the interface 224 is furnished with a parallel-serial conversion circuit, a transmitting circuit, a receiving circuit and a serial-parallel conversion circuit. In addition, the interface 225 is equipped with a control circuit that supplies a power source or a voice signal to the local alarm sounding device 271.

Also, in this embodiment, the fire zone window 111 of the fire control and indicating equipment 101 is furnished with 32 window sections consisting of the paired fire zone lamps 112, abnormal zone lamps 113 and fire zone indicating boards 114 in correspondence with 32 (32 addresses) terminal devices (for fire supervision) of the fire detectors 251 to the transmitters 253. With this structure, the first fire zone lamp 112, the first abnormal zone lamp 113 and the first fire zone indicating board 114 correspond to the indication of the fire information from the terminal device (for example, an analog type photoelectric smoke detector) of address #1, and the 32nd fire zone lamp 112, the 32nd abnormal zone lamp 113 and the 32nd fire zone indicating board 114 correspond to the indication of the fire information from the terminal device (for example, a transmitter) of address #32, respectively, that is, the terminal devices to which addresses are allocated correspond to the respective windows of the fire zone window sections by one to one, also the former correspond to the latter in their order.

Subsequently, the operation of the fire control and indicating equipment 101 will be described with reference to FIGS. 3 to 6.

Figure 3:
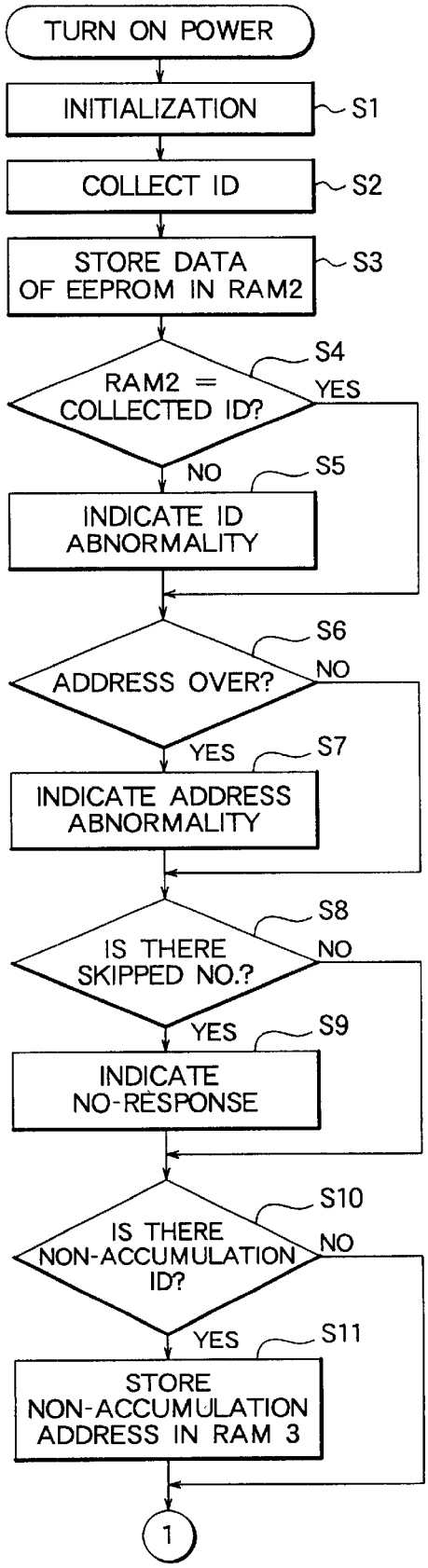
FIG. 3 is a flowchart for explanation of the operation in accordance with the embodiment of the present invention.

First, the initial operation will be described with reference to FIG. 3.

Necessary initialization is executed upon turning on the power source (Step S1), and a plurality of terminal devices are then called in succession. The IDs (classification information) and the addresses of the respective terminal devices are collected from the called terminal devices and then stored in the RAM 1 (Step S2: address collecting means).

Then, the address data and the classification data (IDs) are read from the ROM 2 which is formed of EEPROM and then stored in the RAM 2 (Step S3).

Thereafter, it is discriminated whether the collected IDs of the respective terminal devices are identical with the IDs of the RAM 2, or not (Step S4). If not identical, the abnormal zone lamp 113 of the first zone corresponding to the address, for example, #1 of the terminal device is lighted under control (continuously or flashingly), and the ID abnormality is also indicated by the indicator 126 (for example, code indication). In addition, the failure representation lamp 124 is lighted under control (continuously or flashingly) (Step S5). As a result, an error in the connection between the respective terminal devices (an error in classification) can be known.

Thereafter, it is discriminated whether an address exceeding #32 exists in the collected addresses, or not (Step S6: address discriminating means). If yes, since it is an address out of the permissible set range, the failure representing lamp 124 is lighted under control, and the existence of a terminal device of address-over is indicated by the indicator 126. With this operation, an error in address setting of the terminal devices can be known. In this case, the address of the address-over terminal device may be indicated by the indicator 126.

Also, it is discriminated whether a skipped number exists in the collected addresses, or not (Step S8), and if yes, in the case where no address of, for example, #2 exists, the failure representing lamp 124 and the abnormal zone lamp 113 of the second zone are lighted under control, and the indication of no-response is made by the indicator 126 (Step S9). As a result, it is known that the terminal device of that address is not connected.

Then, when receiving a non-accumulation terminal device, that is, fire information (for example, a physical quantity signal representative of a fire phenomenon from which it is judged that there is a fire, a fire signal, etc.) from which it is judged that there is a fire in the collected IDs, it is immediately judged whether there is a terminal device of the classification to be judged to be in a fire occurring state (Step S10) without executing accumulating operation that judges that it is in the fire occurring state when the above state continues for a given period of time, and if yes, the address of the terminal device in question is stored in the RAM 3. Incidentally, the terminal device which may be judged to be of a fire by the non-accumulation is, for example, a fire detector of the rate of rise heat type or fixed temperature type.

After executing the above processing, fire supervising operation is conducted.

The fire supervising operation may be made such that a plurality of terminal devices are designated by their addresses one by one and called from the fire control and indicating equipment, and fire information such as a fire signal, a physical quantity signal representative of fire phenomenon, etc., is collected from the called terminal device. This embodiment shows one example in which 32 terminal devices are divided into two groups each having 16 terminal devices, and the fire control and indicating equipment calls the plurality of terminal devices by group units. The 16 terminal devices of the called group returns the fire information on the presence/absence of the fire signal (in the case where the address is allocated by a transmitter, a manual fire alarm call point, or an on/off fire detector), or the physical quantity signal representative of fire phenomenon (in the case where an analog type fire detector is used) at a timing allocated to the terminal device in question, out of 16 return timings set subsequent to the group paging signal (the group calling signal from the fire control and indicating equipment).

In other words, for example, the terminal device of #2 sends out the fire information at a second timing out of the return timings subsequent to the paging signal of the first group, and the terminal device of #18 sends out the fire information at a second timing out of the return timings subsequent to the paging signal of the second group.

Figure 4:
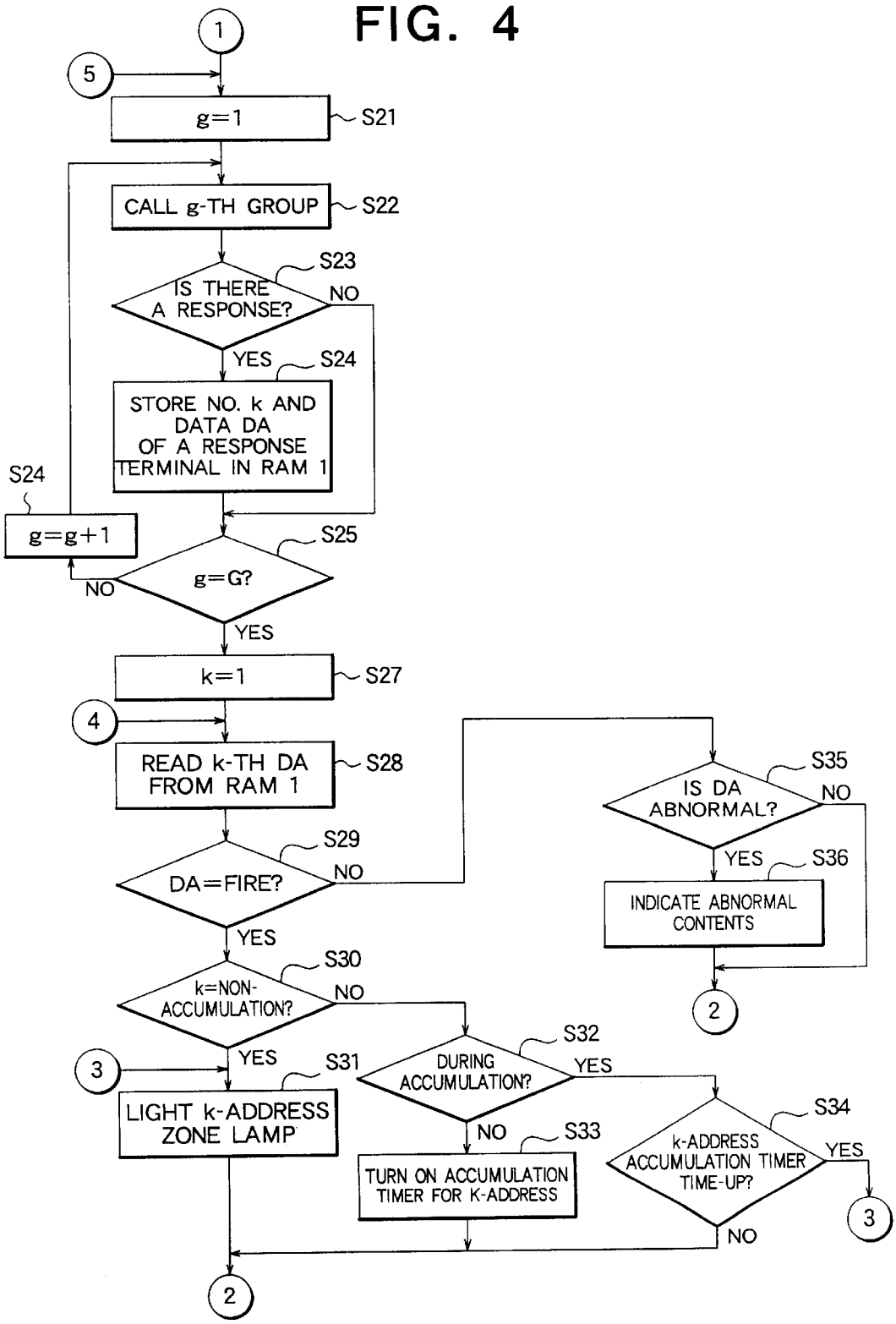
FIG. 4 is a flowchart for explanation of the operation in accordance with the embodiment of the present invention.
Figure 5:
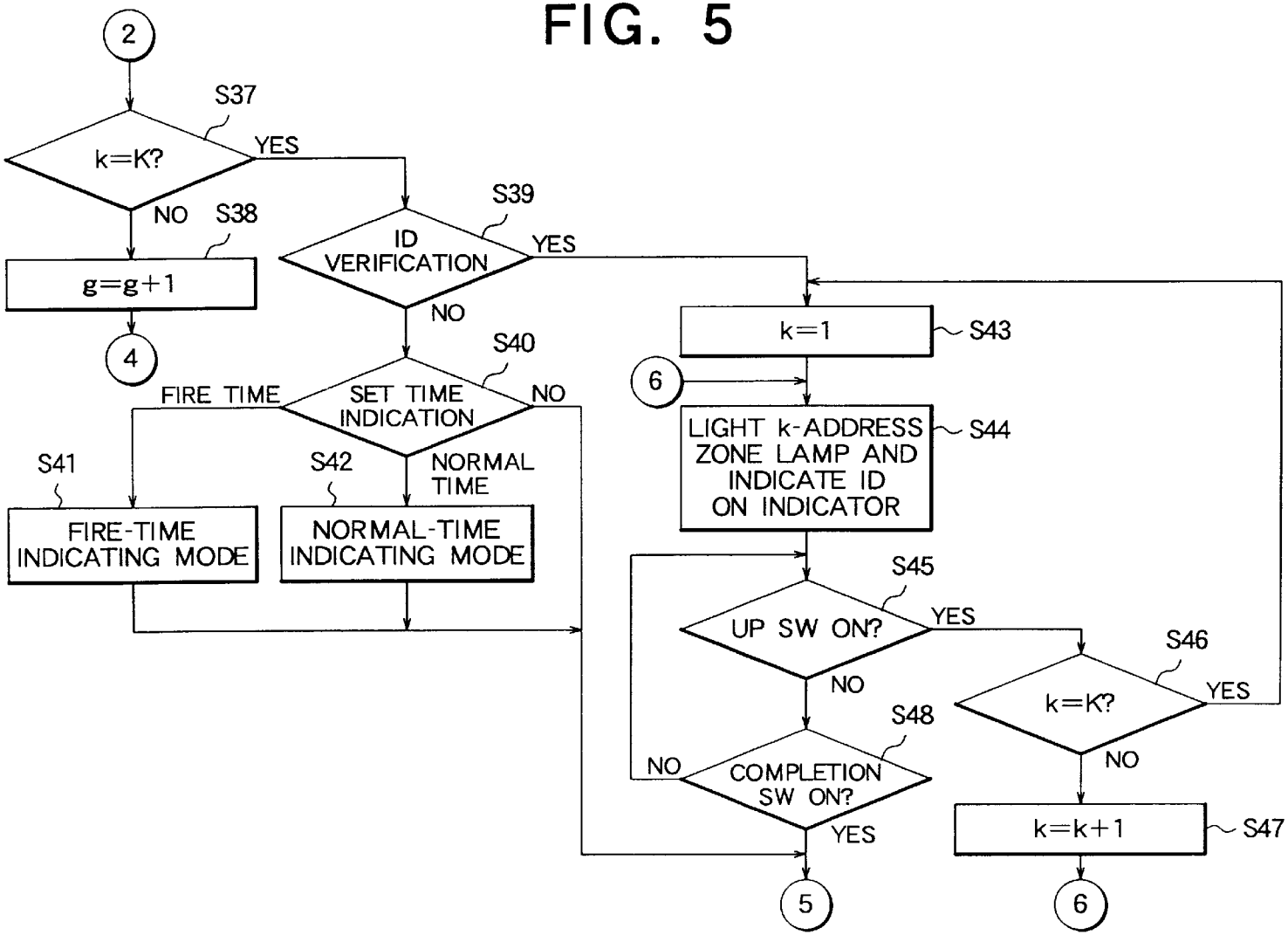
FIG. 5 is a flowchart for explanation of the operation in accordance with the embodiment of the present invention.

Subsequently, the above operation will be described in more detail with reference to FIGS. 4 and 5.

First, in Step S21, for example, a first group 1 is specified as the g-th group, and the first group is called (Step S22). Then, it is recognized whether a response is received, or not (Step S23), and if a response is received, the number k and data DA of the responding terminal device are stored in the RAM 1 (Step S24), and processing advances to Step S25. Likewise, in the case where no response is received in Step S23, processing advances to Step S25.

In Step S25, it is judged whether No. of the group g is the total number G of the group, or not, that is, information on all the groups has been already taken in, or not. If not already, processing advances to a succeeding group in Step S26, and processing returns to Step S22 and the above-mentioned operation is repeated. If the operation has been finished, for example, the terminal device #1 in the first group is specified (Step S27), and data is read from the RAM 1 (Step S28).

Thereafter, it is discriminated whether the read data is representative of a fire, or not (Step S29), and if yes, it is discriminated whether the corresponding terminal device is of the non-accumulation type, or not, on the basis of the information from the RAM 3 (Step S30). If it is of the non-accumulation type, the fire zone lamp 112 at the corresponding address No. k, in this case, the address No. 1 and the fire lamp 121 are lighted immediately. Furthermore, the main alarm sounding device in the fire control and indicating equipment and the local alarm sounding device 271 outside thereof are sounded(Step S31). The functions in Steps S29 and S30 serve substantially as fire state judging means.

On the other hand, if it is not of the non-accumulation type in Step S30, it is discriminated whether the terminal device is now being accumulated, or not (Step S32), and if it is not being accumulated, an accumulation timer (RAM 3 is used) of the terminal device is turned on (Step S33) whereas if it is being accumulated, it is judged whether the accumulation timer is timed up, or not (Step S34). If it is timed up, the fire zone lamp 112 at the address No. 1 is lighted as in the above-mentioned manner in Step S31, and the fire lamp 121 is lighted, to thereby sound the main alarm sounding device in the interior of the fire control and indicating equipment and the local alarm sounding device 271 in the exterior thereof.

Also, if it is not a fire in Step S29, after the accumulation timer of the k-th terminal device is cleared, it is discriminated whether the data is abnormal, or not (Step S35). If the data contents are abnormal due to, for example, a transmission error, the abnormal zone lamp 113 corresponding to the faulty zone is lighted to indicate the abnormality (Step S36). In this situation, the contents of abnormality may be indicated in codes by the indicator 126.

Thereafter, it is judged whether the above-mentioned operation of all the terminal devices, that is, 32 terminal devices in this case, has been completed, or not (Step S37), and if it has not yet been completed, the operation is advanced to a succeeding terminal device in Step S38, and the above-mentioned operation is repeated, and processing is advanced to Step S39 at the time of completing the above-mentioned operation.

In Step S39, a terminal device ID (classification information) verification mode and a timer indication setting mode are manually executed such that the setting switch 132 is depressed, the setting mode is entered, and selectable modes are indicated on the indicator 126. When the ID verification mode is selected, the time setting switch 133 is depressed until that mode is indicated on the indicator 126, and when it is indicated therein, the setting switch 132 is depressed to execute mode determination. When the timer indication setting mode is selected, the setting switch 132, the time setting switch 133 and the setting switch 132 are likewise manipulated in the stated order to determine the mode.

If it is not the terminal device ID verification mode in Step S39, it is judged whether the present mode is the timer indication setting mode, or not, in Step S40. If it is not the timer indication setting mode, processing returns to Step S21, and the above-mentioned operation is repeated, and the fire-time indicating mode is entered if a fire-time is selected in the time indication setting mode (Step S41) whereas the normal-time indicating mode is entered if a normal-time is selected (Step S42). In any of these cases, processing returns to Step S21 and the above-mentioned operation is repeated.

On the other hand, if it is the terminal device ID verification mode in Step S39, the terminal device of #1 is specified (Step S43), the first fire zone lamp 112 is lighted (flashingly or continuously), and the ID of that terminal device is indicated on the indicator 126 (Step S44). Subsequently, it is discriminated whether an up-switch, for example, the time setting switch 133 is depressed, or not, in order to verify the ID of a succeeding terminal device (Step S45). If it is depressed, it is discriminated whether it is a final terminal device, that is, the terminal device of #32 in this example, or not (Step S46). If it is not the final terminal device, processing advances to a succeeding terminal device (Step S47), and returns to Step 44 and the above-mentioned operation is repeated. If it is the final terminal device, processing returns to Step S43 and the above-mentioned operation is repeated, likewise.

Also, if the up switch is not depressed in Step S45, it is confirmed whether a completion switch, for example, a fire alarm resetting switch 136 is depressed, or not (Step S46). If it is not depressed, processing returns to Step S45 and waits until the fire alarm resetting switch is depressed, and when the fire alarm resetting switch 136 has been depressed, processing returns to Step S21 and the above-mentioned operation is repeated.

Figure 6:
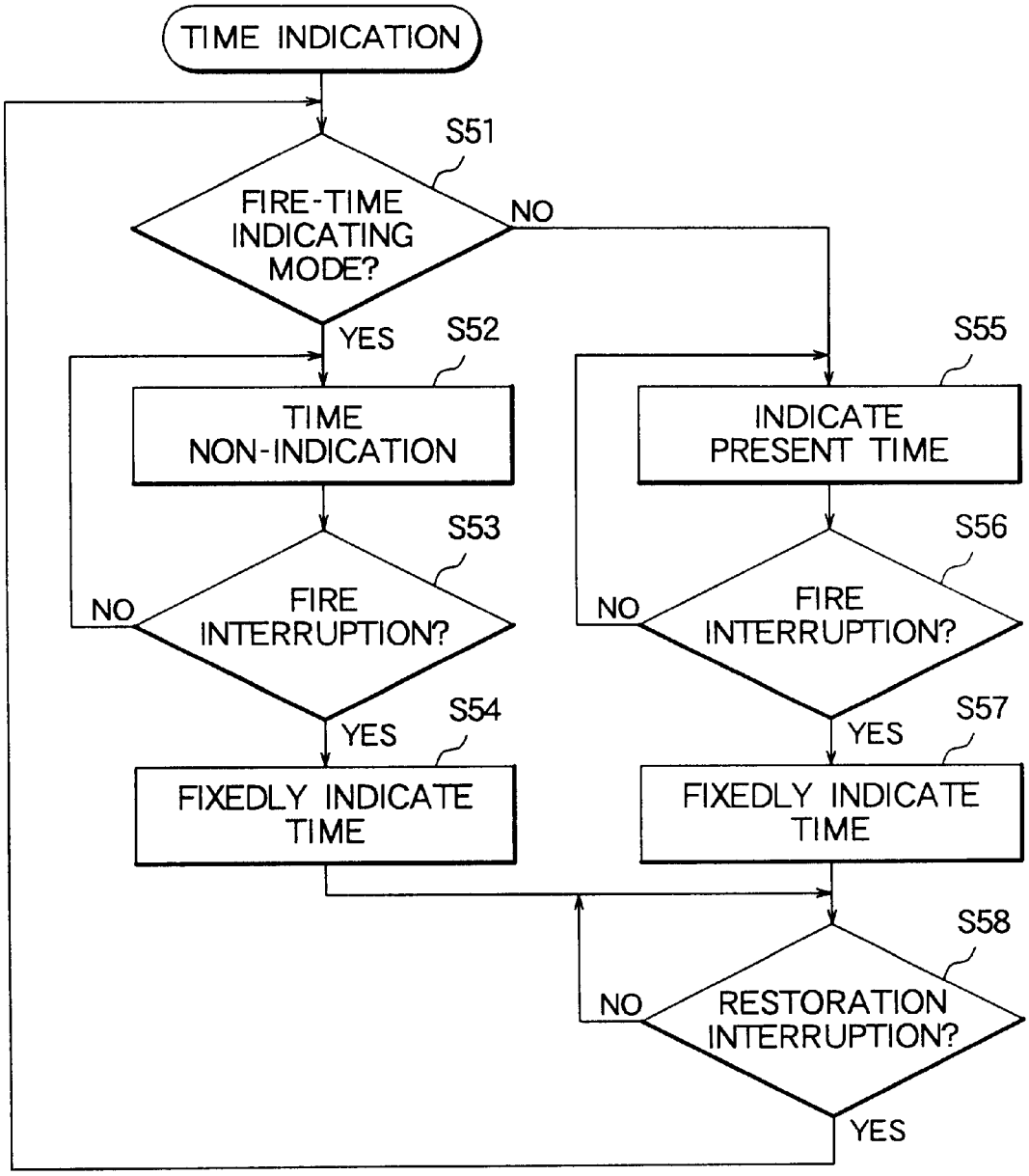
FIG. 6 is a flowchart for explanation of the operation in accordance with the embodiment of the present invention.

Subsequently, the operation of time indication will be described in more detail with reference to FIG. 6.

First, it is discriminated whether the present mode is the fire-time indicating mode, or not (Step S51), and if it is the fire-time indicating mode, processing waits for fire interruption command (Step S53) without indicating a time (Step S52). If fire interruption command comes, its time is fixedly displayed, indicating that a first fire report has been made at that time.

On the other hand, if it is not the fire indicating mode in Step S51, the present time is displayed (Step S55), and processing waits for fire interruption command (Step S56). If fire interruption command comes, its time is fixedly displayed, indicating that a fire has occurred at that time (Step S57).

Then, after the time at which a fire has occurred is fixedly displayed in Step S54 or S57, it is discriminated whether restoration interruption is made, or not, that is, whether the fire alarm resetting switch 136 is depressed, or not, in Step S58. If it is not depressed, processing waits for the depression of the fire alarm resetting switch 136, and processing returns to Step S51 at the time of depressing the fire alarm resetting switch 136, and the above-mentioned operation is repeated.

Figure 7:
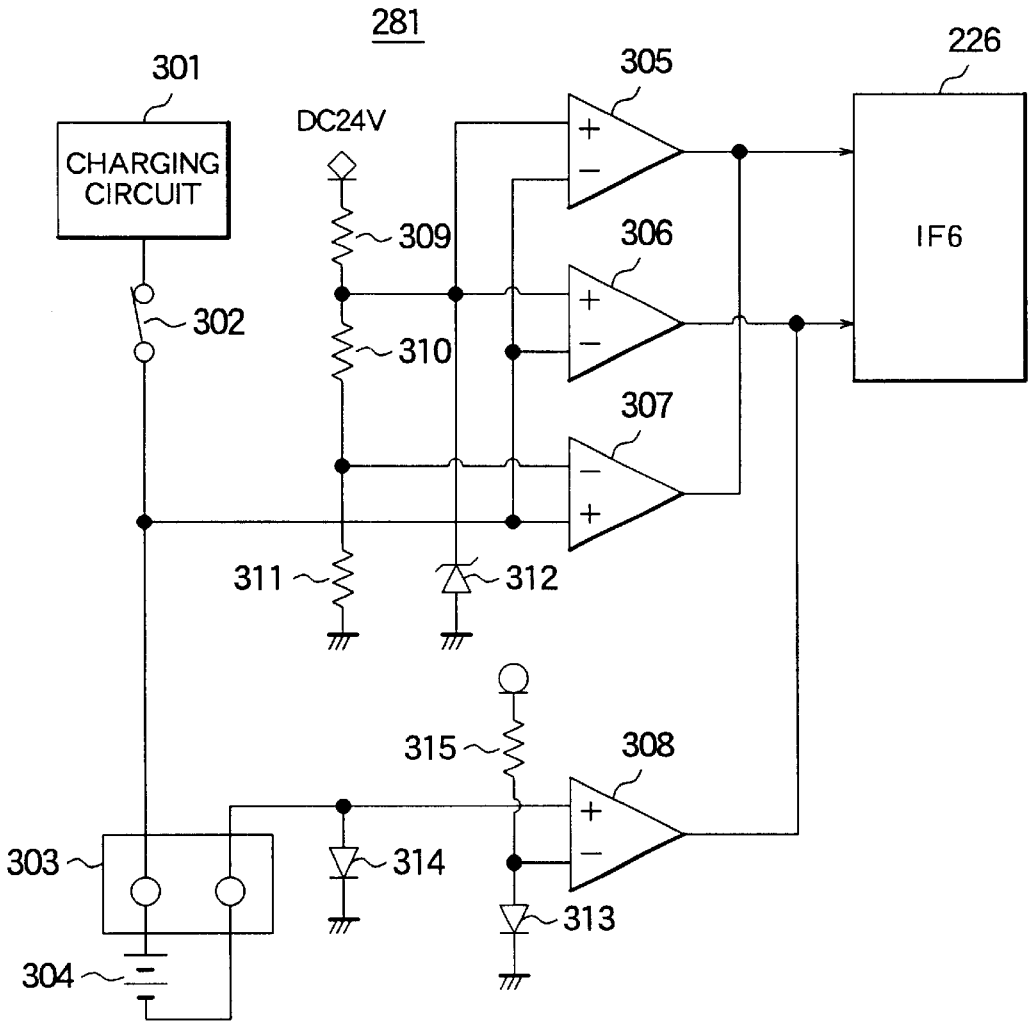
FIG. 7 is a circuit structural diagram showing a standby power supply in accordance with the embodiment of the present invention.

FIG. 7 is a structural diagram showing one example of a specific circuit structure of the standby power supply 281 shown in FIG. 2.

In the figure, reference numeral 301 denotes a charging circuit; 302, a normally on-state switch; 303, a connector; 304, a charging battery (for example, Ni-Cd battery, lead battery); and 305 to 308, comparison circuits. The positive electrode side of the battery 304 is connected to the charging circuit 301 through the connector 303 and the switch 302, also connected to the inverse input terminal of the comparison circuits 305 and 306 through the connector 303, and further connected to the non-inverse input terminal of the comparison circuits 307. The negative electrode side of the battery 304 is connected to the non-inverse input terminal of the comparison circuit 308 through the connector 302.

Incidentally, the comparison circuits 305 and 306 detect a case in which the charging circuit 301 or the like is in failure, with the result that the voltage of the battery 304 becomes higher than a reference voltage, and the comparison circuit 307 detects a case in which, for example, short-circuiting occurs in the connector 303 with the result that the voltage of the battery 304 becomes lower than the reference voltage. Also, the comparison circuit 308 detects a case in which, for example, the battery 304 is detached at the portion of the connector 303 and falls off.

Reference numerals 309 to 311 denote a voltage-division resistors connected between the power source terminal which is, for example, DC 24V in supply voltage and the ground. A node between the resistors 309 and 310 is connected to the inverse input terminals of the comparison circuits 305 and 306, and a node between the resistors 310 and 311 is connected to the non-inverse input terminal of the comparison circuits 307. Also, a Zener diode 312 is connected between the node of the resistors 309, 310 and the ground.

Reference numerals 313 and 314 denote diodes, the cathode of the diode 313 is grounded, and the anode thereof is connected to the power source terminal through the resistor 315 and also connected to the inverse input terminal of the comparison circuit 308. The diode 314 is connected between the non-inverse input terminal of the comparison circuit 308 and the ground.

The output terminals of the comparison circuits 305 and 307 and the output terminals of the comparison circuits 306 and 308 are commonly connected to each other, respectively, and then connected to the interface 226 (IF6).

The comparison circuits 305 and 306 generate an output signal H in level as a normal state when the voltage of the battery 304 is lower than a reference voltage which is the Zener voltage of the Zener diode 312 connected to the non-inverse input terminal thereof, whereas they generate an output signal L in level as a high-voltage state when the voltage of the battery 304 is higher than the reference voltage.

Also, the comparison circuit 307 generates an output signal H in level as a normal state when the voltage of the battery 304 is higher than a reference voltage which is the terminal voltage of the resistor 311 connected to the inverse input terminal thereof, whereas it generates an output signal L in level as a low-voltage state when the voltage of the battery 304 is lower than the reference voltage.

Further, the comparison circuit 308 generates an output signal H in level as a state in which the battery 304 does not fall off when the forward drop voltage of the diode 314 is higher than a reference voltage which is a voltage substantially determined by the voltage division ratio of the diode 313 and the resistor 315 which are connected to the inverse input terminal thereof, whereas it generates an output signal L in level as a state in which the battery 304 falls off when the forward drop voltage of the diode 314 is lower than the reference voltage.

In the above-mentioned operation, since the output terminals of the comparison circuits 305 and 307 and the output terminals of the comparison circuits 306 and 308 are commonly connected to each other, respectively, and then connected to the interface 226 (IF6), the output of the comparison circuit 308 when the battery 304 falls off becomes L in level, as a result of which the output of the comparison circuit 306 also becomes L in level forcedly. Similarly, since the output of the comparison circuit 307 when the battery 304 is short-circuited becomes L in level, the output of the comparison circuit 305 also becomes L in level forcedly. In addition, sin ce the outputs of the comparison circuits 305 and 306 when the char ging circuit 301 is in failure become L in level, the outputs of the comparison circuits 307 and 308 also become L in level forcedly.

Figure 8:
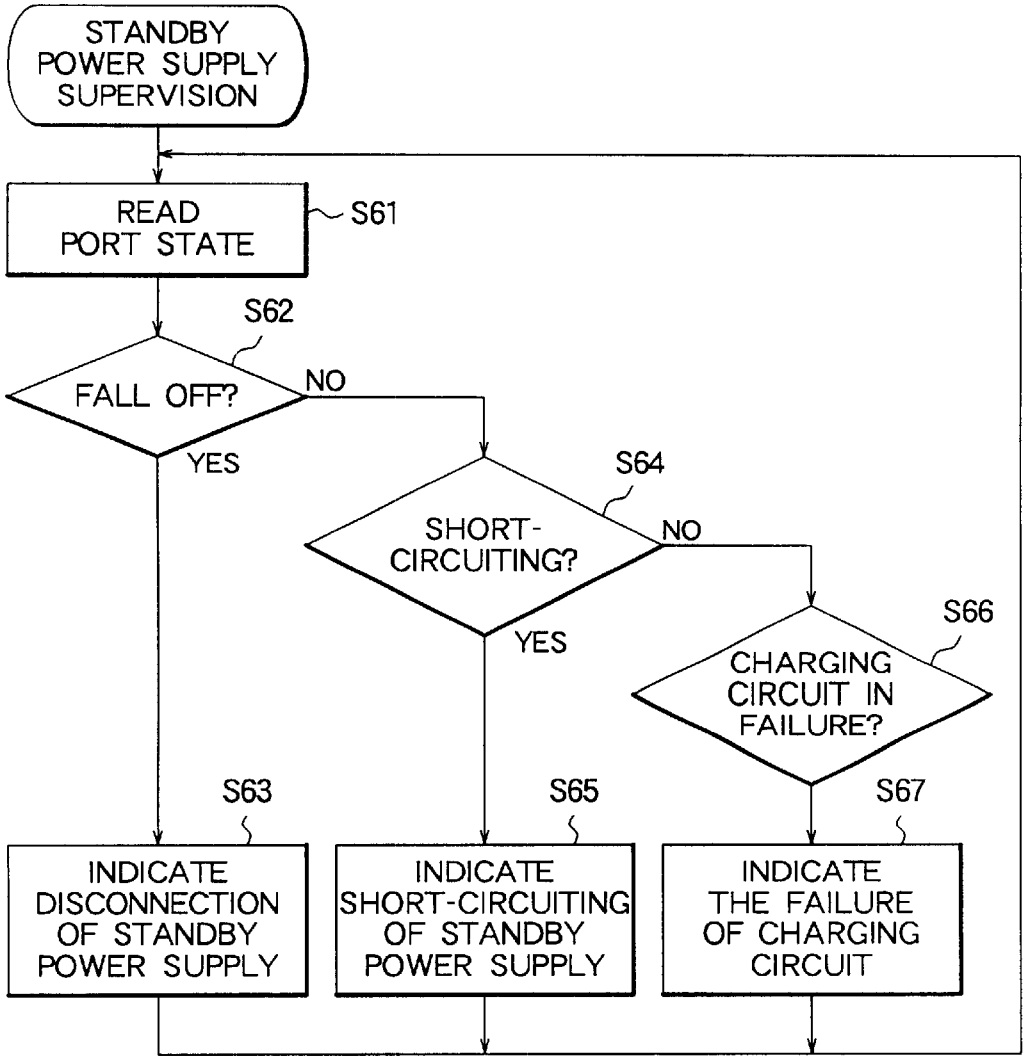
FIG. 8 is a flowchart for explanation of the operation in FIG. 7.

Subsequently, the supervising operation of the fire control and indicating equipment 101 with respect to the standby power supply shown in FIG. 7 will be described with reference to FIG. 8.

First, a port state is read, that is, a state of the standby power supply 281 is read through the interface 226 (Step S61), and it is discriminated whether the battery 304 is removed, or not (Step S62). If the battery 304 is removed, a notice that the battery 304 is removed is given to the exterior, for example, by flashing the standby power supply lamp 123 and the failure representing lamp 124, and also its contents are displayed on the indicator 126 by code number.

On the other hand, if the battery 304 does not fall off in Step S62, it is discriminated whether the battery is short-circuited, or not (Step S64). If it is in a short-circuiting state, a notice that the battery 304 is short-circuited, that is, the standby power supply 281 is short-circuited is given to the exterior, for example, by flashing the standby power supply lamp 123 and the failure representing lamp 124, and also its contents are displayed on the indicator 126 by code number.

If the battery 304 is not short-circuited in Step S64, it is discriminated whether the charging circuit 301 is in failure, or not (Step S66). If it is in a failure state, a notice that the charging circuit 301 is in failure is given to the exterior, for example, by flashing the standby power supply lamp 123 and the failure representing lamp 124, and also its contents are displayed on the indicator 126 by code number.

As described above, in this embodiment, since the zone lamps as a plurality of fire zone indicating means corresponding to a plurality of terminal devices for fire supervision to which different addresses are allocated, respectively, by one-to-one, are disposed in the fire control and indicating equipment, the structure can be downsized. As a result, the simplification of the structure, the simplification of the correspondence of the fire surveillance zones to the addresses, the facilitation of construction and the reduction of the costs can be made. In addition, not only is the fire information is collected, but also the process of judging a fire and generating an alarm can be made on the basis of the collected fire information.

Also, in this embodiment, each of the plural terminal devices is equipped with address setting means (for example, a DIP switch, a rotary DIP switch, EEPROM, etc.), and the fire control and indicating equipment includes storing means (for example, program, EEPROM, etc.) for storing the addresses set on the plurality of terminal devices, address collecting means for paging the plurality of terminal devices in succession to collect the addresses set by the address setting means from the called terminal device, address discriminating means for discriminating whether the addresses collected by the address collecting means are addresses stored in the storing means, or not, and indicating means for indicating a discrimination result when the address discriminating means discriminates that the collected addresses are addresses different from the addresses stored in the storing means. With this structure, even if an address out of a range in which the setting of addresses are allowable in advance is called, this address is surely caught to enable abnormal indication.

Further, in this embodiment, different IDs (classification information) are given to the plurality of terminal devices according to the classification of the terminal devices, respectively, and the fire control and indicating equipment is furnished with fire state judging means for judging a fire state immediately when collecting fire information collected from the terminal device of a specified classification from which it is judged that there is a fire. With this structure, it is instantly judged whether the terminal device is of the type having an accumulation function, or not, according to the classification of the terminal device, to make it possible to generate an alarm.

Still further, in this embodiment, IDs (classification information) are allocated to the plurality of terminal devices according to the classification of the terminal devices, and the fire control and indicating equipment is furnished with an indicator for indicating at least the classification of the plurality of terminal devices, an indicator lamp for indicating the state of the terminal devices in correspondence with the plurality of terminal devices by one to one, and the classification indication switch, for example, using a setting switch for specifying the plurality of terminal devices, and when the classification indication switch is manipulated, the classification of the specified terminal device is indicated on the indicator, and the indicator lamp corresponding to the terminal device is lighted under control. With this structure, the correspondence of the equipment to the terminal devices can be confirmed, and the reliability of the equipment can be improved.

Yet still further, in this embodiment, the fire control and indicating equipment includes timer means having a timer section and an indicator which indicates a time output of the timer section, and time mode switching means for switching, in indicating a time output of the timer section on the indicator, between a normally indicating mode in which the time output is always indicated on the indicator, and a fire-time indicating mode in which the time output is not normally indicated on the indicator but the time output is indicated on the indicator when it is judged that there is a fire from the fire information. Also, the time indication is fixedly indicated on the indicator at the time when it is judged that the collected fire information is representative of the occurrence of a fire. Accordingly, a time at which a fire occurs can be instantly confirmed.

Yet still further, in this embodiment, since the contents of the standby power supply such as the disconnection and short-circuiting of the standby power supply and the failure of the charging circuit are finely supervised, the reliability of the equipment can be improved.

In the above-mentioned embodiment, a so-called R-type fire control and indicating equipment was described. However, the P-type fire control and indicating equipment is similarly applicable to the present invention with the same effects.

The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A fire alarm system in which a plurality of terminal devices for fire supervision to which different addresses are allocated, respectively, are connected to a fire control and indicating equipment, and said fire control and indicating equipment calls a terminal device by its address to collect fire information from said called terminal device, characterized in that said fire control and indicating equipment includes a plurality of fire zone indicating means corresponding to said plurality of terminal devices by one to one.

2. A fire alarm system as claimed in claim 1, characterized in that the addresses are allocated in serial numbers to said plurality of terminal devices, respectively, and the same zone numbers as the addresses are allocated to said plurality of fire zone indicating means in succession.

3. A fire alarm system as claimed in claim 1, characterized in that said fire zone indicating means comprises a fire zone lamp, an abnormal zone lamp and a zone indication board.

4. A fire alarm system as claimed in claim 3, characterized in that there is provided discriminating means for discriminating the fire information collected from said terminal devices, and when the discrimination result of said discriminating means is indicative of abnormality except fire, the abnormality are indicated by said abnormal zone lamp.

5. A fire alarm system in which a plurality of terminal devices for fire supervision to which different addresses are allocated, respectively, are connected to a fire control and indicating equipment, and said fire control and indicating equipment calls a terminal device by its address to conduct at least one of the collection of fire information from said called terminal device and/or the sending of an instruction to said called terminal device, characterized in that address setting means is provided in each of said plurality of terminal devices, and said fire control and indicating equipment comprises storing means for storing the addresses to be set on said plurality of terminal devices, address collecting means for paging said plurality of terminal devices in succession to collect the addresses set by said address setting means from said called terminal device, address discriminating means for discriminating whether the addresses collected by said address collecting means are addresses stored in said storing means, or not, and indicating means for indicating a discrimination result when said address discriminating means discriminates that the collected addresses are addresses different from the addresses stored in said storing means.

6. A fire alarm system as claimed in claim 5, characterized in that said fire control and indicating equipment is provided as said indicating means with a plurality of indicator lamps corresponding to said plurality of terminal devices by one to one, said storing means stores the addresses of said terminal devices connected to said fire control and indicating equipment in correspondence with said plurality of indicator lamps therein, and said indicating means controls the lighting of said indicator lamps corresponding to said addresses stored in said storing means when said discriminating means discriminates that said collected addresses are addresses different from the addresses stored in said storing means.

7. A fire alarm system in which a fire control and indicating equipment has accumulating means for collecting fire information from a plurality of terminal devices for fire supervision in succession, and judging that there is a fire when collecting fire information from which it is judged that a fire occurs from said terminal device over a predetermined period of time, in the case where the collected fire information is information from which it is judged that a fire occurs, characterized in that different classification information depending on the classifications of the terminal devices is allocated to said plurality of terminal devices, and said fire control and indicating equipment includes fire state judging means for judging that there is a fire immediately when collecting the fire information collected from the terminal device of a specific classification which is the fire information from which it is judged that a fire occurs.

8. A fire alarm system as claimed in claim 7, characterized in that there is provided classification storing means for storing the classification information of said plurality of terminal devices which are connected to said fire control and indicating equipment therein, and said fire state judging means judges whether the terminal device from which the fire information is collected is of the specific classification, or not, according to the classification information stored in said classification storing means.

9. A fire alarm system in which a plurality of terminal devices for fire supervision to which different addresses are allocated, respectively, are connected to a fire control and indicating equipment, and said fire control and indicating equipment calls said terminal device by its address to collect fire information from said called terminal device, characterized in that classification information is allocated to said plurality of terminal devices according to the classification of the terminal devices, and said fire control and indicating equipment comprises an indicator for indicating at least the classification of said plurality of terminal devices, an indicator lamp for indicating the state of said terminal devices corresponding to said plurality of terminal devices by one to one and a classification indication switch for selecting a terminal device from said plurality of terminal devices, so as to indicate the classification of the designated terminal device in said indicator and control the lighting of said indicator lamp corresponding to said designated terminal device when the classification indication switch is manipulated.

10. A fire alarm system in which a plurality of terminal devices for fire supervision are connected to a fire control and indicating equipment, and said fire control and indicating equipment collects fire information from said plurality of terminal devices and judges whether a fire occurs or not from said collected fire information, characterized in that said fire control and indicating equipment comprises timer means having a timer section and an indicator which indicates a time output of said timer section, and time mode switching means for switching, in indicating a time output of said timer section on said indicator, between a normally indicating mode in which the time output is always indicated on said indicator, and a fire-time indicating mode in which the time output is not normally indicated on said indicator but the time output is indicated on said indicator when it is judged that there is a fire from the fire information.

11. A fire alarm system as claimed in claim 10, characterized in that said timer means fixedly indicates the timer indication on said indicator at a point of time of judgement when it is judged that a fire occurs from said collected fire information.

12. A fire alarm system in which a plurality of terminal devices for fire supervision are connected to a fire control and indicating equipment, and said fire control and indicating equipment receives fire information from said terminal devices, wherein said fire control and indicating equipment is provided with supervising means for supervising an abnormality of an interior of a standby power supply installed in or connected to said fire control and indicating equipment on the basis of detection information from said standby power supply;

wherein said supervising means comprises first discriminating means for discriminating the disconnection of said standby power supply, second discriminating means for discriminating a short-circuiting of said standby power supply, and third discriminating means for discriminating a failure of a charging circuit in said standby power supply.

13. A fire alarm system as claimed in claim 12, wherein said standby power supply includes detecting means for detecting a battery voltage and a reference voltage.

14. A fire alarm system as claimed in claim 13, wherein said detecting means comprises first and second comparison circuits for detecting the failure of said charging circuit, a third comparison circuit for detecting the short-circuiting of said battery and a fourth comparison circuit for detecting the disconnection of said battery.

15. A fire alarm system as claimed in claim 12, wherein said fire control and indicating equipment includes indicating means for indicating the abnormality of the interior of said standby power supply.

16. A fire alarm system in which a plurality of terminal devices for fire supervision are connected to a fire control and indicating equipment, and there are provided a plurality of fire zone lamps which light in correspondence with said the terminal devices that send the fire information from which it is judged that a fire exists when said fire control and indicating equipment receives fire information from said terminal devices and it is judged that the fire exists from the fire information received from any one of said terminal devices, wherein said fire control and indicating equipment includes an indicator and a plurality of abnormal-zone lamps corresponding to said plurality of fire zone lamps, said abnormal-zone lamps are lighted under control when an abnormality occurs in said terminal device in charge of said corresponding fire zone lamp, and the abnormality contents are indicated on said indicator.

17. A fire alarm system as claimed in claim 16, wherein said plurality of fire zone lamps and said plurality of abnormal-zone lamps disposed in correspondence with said fire zone lamps are disposed in correspondence with said plurality of terminal devices by one to one.

18. A fire alarm system as claimed in claim 16, wherein said indicator is made up of at least one of seven-segment display, and the abnormality contents are indicated in codes.

* * * * *